United States Patent [19]

Yamasaki et al.

[11] 3,946,584

[45] Mar. 30, 1976

[54] HYDROSTATIC EXTRUSION METHOD AND APPARATUS

[75] Inventors: Tatsuo Yamasaki, Kobe; Hideaki Ide, Akishi; Yoshihiro Yamaguchi, Ashiya; Tomiharu Matsushita, Nishinomiya; Yuuzi Nakahara, Osaka, all of Japan

[73] Assignee: Kobe Steel, Ltd., Kobe, Japan

[22] Filed: Apr. 11, 1974

[21] Appl. No.: 460,172

[30] Foreign Application Priority Data

Apr. 11, 1973 Japan ..... 48-41104
June 4, 1973 Japan ..... 48-63508

[52] U.S. Cl. ..... 72/60; 72/56; 72/264; 72/476

[51] Int. Cl.[2] ..... B21J 5/04

[58] Field of Search ..... 72/60, 56, 476, 264; 29/474.3

[56] References Cited

UNITED STATES PATENTS

| | | | |
|---|---|---|---|
| 3,677,060 | 7/1972 | Loqvist | 72/476 |
| 3,751,957 | 8/1973 | Nilsson | 72/60 |
| 3,807,032 | 4/1974 | Nilsson | 29/474.3 |
| 3,808,860 | 5/1974 | Yamaguchi et al. | 72/60 |
| 3,817,069 | 6/1974 | Hauser et al. | 72/60 |

*Primary Examiner*—Milton S. Mehr
*Assistant Examiner*—Joseph A. Walkowski
*Attorney, Agent, or Firm*—Oblon, Fisher, Spivak, McClelland & Maier

[57] ABSTRACT

A hydrostatic extrusion method and apparatus for the extrusion of tubes is disclosed wherein the simplified structure of the nose or tip portion of the billet and the cooperating surfaces of the die defining the die cavity and those of the mandrel facilitate an improved initial sealing among the associated surfaces of the die, billet and mandrel. Such an initial sealing is effected between such interfaces of the members and billet at a point which is located substantially rearwardly from the position at which the actual extrusion to the final tubular configuration occurs between the bearing portion of the die and the cooperating sizing portion of the mandrel. Such structure and method permits the extrusion of tubes having walls of asymmetric or non-circular configurations in cross section, even those of complex configurations. In order to further enhance the efficacies of the present invention, the mandrel is provided with a head portion which may be replaced, or exchanged as desired, and a position-aligning member is associated with the mandrel in order to maintain the proper orientation of the mandrel relative to the die. The mandrel may also have a specifically designed configuration in order to provide the inner surface of the tube extruded with a gloss finish.

19 Claims, 24 Drawing Figures

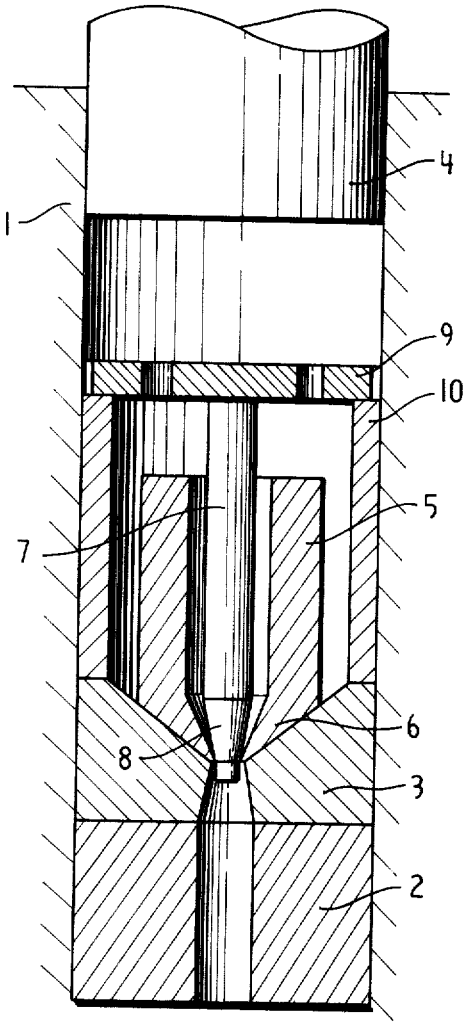
FIG. 1
PRIOR ART
FIG. 2
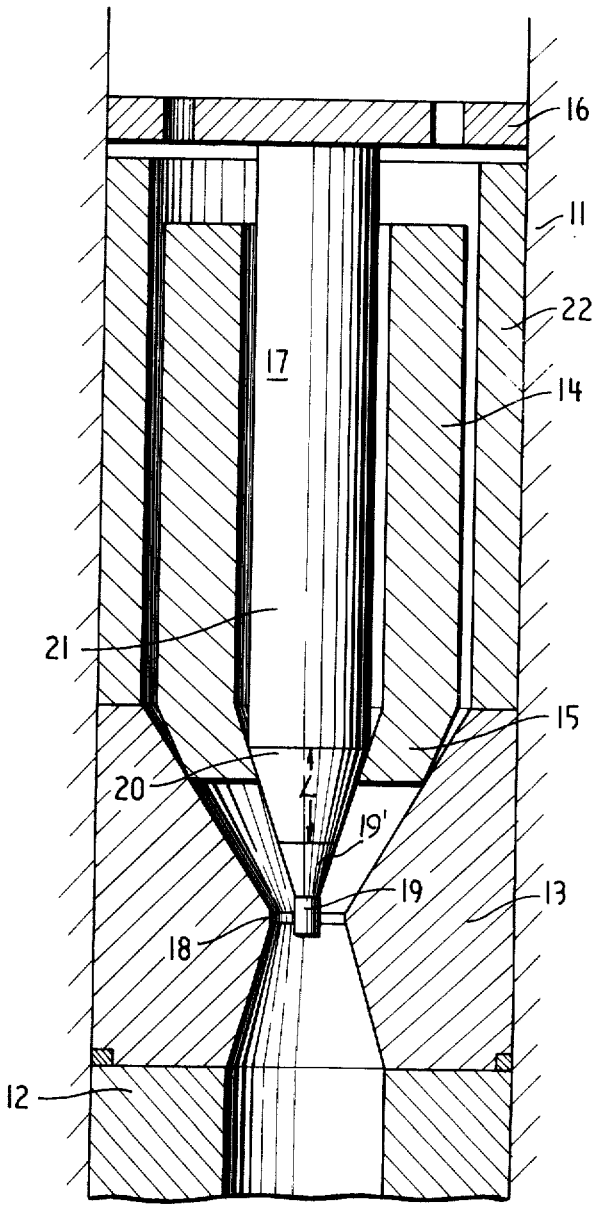

HYDROSTATIC EXTRUSION METHOD AND APPARATUS

BACKGROUND OF THE INVENTION

1. Field of the Invention:

The present invention relates generally to hydrostatic extrusion methods and apparatus, and more particularly to a method and apparatus for hydrostatically extruding tubes including those tubes having external and internal peripheral surfaces which are irregular or asymmetric as seen in cross-section.

2. Description of the Prior Art:

Heretofore, among the various sealing methods and apparatus used in hydrostatic extrusion systems, one such method employs suitable means which effectively seals the tip portion of the billet while another method employs similar means which effectively seals the rear end portion of the billet. For example, the latter conventional method is illustrated in FIG. 1, such method being of the fixed mandrel type. A container 1 has a die 3, supported by means of a die-supporting body 2, disposed within the forward, hollow portion thereof, while a stem 4 is reciprocably disposed within the rear, hollow portion thereof. Within the conical cavity of the die 3 there is disposed the nose or tapered tip portion 6 of an annular billet 5, the diameter of the opening at the tip portion 6 being slightly less than that of a mandrel 7, the conical tip portion 8 of the mandrel 7 being inserted through the opening of the billet 5. The mandrel 7 is affixed to a mandrel ring 9 at the rear end thereof and the mandrel ring 9 is adapted to abut a mandrel supporting cylinder 10.

When extruding a tube having a circular cross-section, the mandrel 7 is advanced together with the mandrel ring 9 until the forward face of the mandrel ring 9 abuts the rear face of the mandrel supporting cylinder 10, whereupon forward progress of mandrel 7 is terminated. The tip or nose opening of the billet 5 is formed so as to have a diameter smaller than that of the mandrel 7, the tapered or conical nose portion 8 of the mandrel 7 being disposed through the aforesaid opening of the billet 5 so as to effect sealing therebetween. The forward, outer peripheral, conical surface of the billet 5 is likewise disposed within the hollow tapered or inner conical surface of the die 3 for similarly effecting sealing therebetween, such interfitting components serving to completely seal the engaged surfaces of the tip portion of the mandrel 7, billet 5 and the conical surface of the die cavity, respectively. It should be noted that the nose or tip portion of billet 5 has a sharp edge so as to effectively accomplish the desired sealing along the aforesaid tip portions as shown in FIG. 1, and thus it can be readily appreciated that the preparation and formulation of the nose portion of billet 5 requires an excessive number of man hours. In operation, when the stem 4 is advanced, the internal pressure within the container will of course be raised, and when such internal pressure reaches a predetermined value, the billet 5 will then be extruded as a tube through the annular interstice existing between die 3 and the tip portion of mandrel 7.

According to the aforenoted method, the pressure medium is disposed within cylinder 10 and about the inner and outer peripheral surfaces of billet 5 such that when the pressure medium is subjected to the high extrusion pressures, the medium will be forced into contact with the surfaces of the mandrel 7 and the billet 5 as well as the surfaces of the die 3 and cylinder 10, and the billet 5, whereupon the extrusion breakthrough pressure becomes relatively low. However, the pressure medium thus forced into contact with the various noted surfaces adversely affects the smoothness of the surfaces of the tube extruded. In addition, as the sealing is effected between the smallest diameter portion of the tapered or conical portion of the mandrel and the bearing portion of die 3, in order to prepare the nose portion of the billet, a great reduction-of-area-percentage is required for providing the sharp edge of the nose of the billet, and thus the cost of manufacture of the billets will be substantially increased even in instances where extrusion of a tube having a circular cross section is to be accomplished.

Furthermore, with respect to the aforesaid extrusion method, the extruded tube wall interstice defined between the small-diameter tip portion of the mandrel and the bearing portion of the die is such that the extrusion of a tube having an irregularly configured cross section is quite limited to the extent wherein only minor modifications from the circular cross section would be able to be attained. In other words, the extrusion of a tube having a wall of an irregular configuration is subject to other limitations in addition to those presented for a tube of circular cross-section. More particularly, as the sealing against undesired leakage of the pressure medium is effected due to the intimate contact between the inner conical surface of the die cavity and the forward, outer, conical peripheral surface of the billet and between the forward inner, conical, peripheral surface of the billet and the forward, outer, conical portion of the mandrel, the nose portion of the billet should be formed so as to have a configuration whose outer peripheral surface conforms to the inner conical surface of the die and whose inner peripheral surface conforms to the outer conical portion of the mandrel.

More specifically, in the instance that a tube having a wall of a substantially flat configuration in cross section is desired to be extruded according to the prior art method disclosed within FIG. 1, the outer and inner peripheral surfaces of the billet should have configurations which respectively conform to the configurations of the contacting surfaces of the die and mandrel, such as for example, elliptical configurations in cross section. Such requirements impose tremendous limitations upon the billet preparation apparatus designed to produce a billet having component portions of such desired configurations with accompanying difficulties being experienced in the technology and machining or the like required therefor. Thus, such billets are quite costly and are not readily adapted for industrial applications.

Furthermore, in the extrusion of tubular products according to hydrostatic extrusion methods, the outer peripheral configuration of the tube is governed by the opening within the die while the inner peripheral configuration thereof is dependent upon the sizing portion of the mandrel. The axial centering of the die and mandrel may be easily achieved wherein a tube having a circular cross section is desired, however, when a tube having a wall of an asymmetric or non-circular cross section is desired, such as for example, an ellipse, the relative positions of the die and mandrel should be adjusted prior to the extrusion and such relationship should be maintained constant throughout the period of pressurizing the container as well as the extrusion of the billet, such thereby presenting considerable additional difficulties to be resolved for such extrusion processes.

A still further disadvantage of such a conventional hydrostatic extrusion method, is that, as has been referred to earlier, the presence of the pressure medium along the surfaces of the die, the billet and the mandrel results in the poor exhibition of gloss characteristics upon the inner surface of the extruded tube due to the absence of direct contact between the billet and the mandrel due to the interdisposition of the pressure medium or lubricant therebetween. Still further, since the conical, inner peripheral surface of the billet remains in contact with the sizing or bearing portion of the mandrel, with the pressure medium being interposed therebetween, until the billet reaches a position at which its final inner and outer configurations are formed by the extrusion between the tip portion of the mandrel and the bearing portion of the die, then undesirable inner surface conditions often result upon the extruded tube, such as for example, the appearance of ripples or dimples thereon.

SUMMARY OF THE INVENTION

Accordingly, it is an object of the present invention to provide a hydrostatic extrusion method which simplifies the preparation of the nose or tip portion of the billet and which facilitates the initial sealing among the die, billet and mandrel components thereby permitting the extrusion of tubes having walls of irregular or asymmetric configurations.

Another object of the present invention is to provide a hydrostatic extrusion method and apparatus which permits the positional adjustment of a mandrel with respect to the die either in an axial or a circumferential direction thereof.

Still another object of the present invention is to provide a hydrostatic extrusion apparatus and method within which the head portion of the mandrel is removable from the body portion thereof for replacement of the same.

A further object of the present invention is to provide a hydrostatic extrusion method and apparatus which provides a metallic-gloss finish to the inner surface of the tube extruded.

According to the first aspect of the present invention, there is provided a hydrostatic extrusion method for tubes, whereby the billet is extruded through an annular interstice defined between the bearing portion of the die and the sizing portion of the mandrel. The nose or tip portion of the billet is provided with frusto-conical, inner and outer peripheral surfaces, the frusto-conical inner peripheral surface of the billet having, in its longitudinal cross-section, an inclined angle greater than or equal to that of the sealing portion of the mandrel while the frusto-conical outer peripheral surface of the billet similarly has, in its longitudinal cross-section, an inclined angle less than or equal to that of the approach portion of the die defining the die cavity with respect to the axial line of the mandrel, thereby presenting considerably reduced contacting areas therebetween. The billet is inserted into the container of the extruder, and the mandrel is advanced into the hollow portion of the billet so as to effect the preliminary sealing between the approach portion of the die, the nose portion of the billet, and the sealing portion of the mandrel. The mandrel is subsequently advanced a small additional distance so as to thereby effect the initial sealing and insure positive sealing between the approach portion of the die portion defining the die cavity and the frusto-conical, outer peripheral surface of the billet as well as between the frusto-conical inner peripheral surface of the billet and the sealing portion of the mandrel. At such time, the rear diameter portion of the mandrel will abut the mandrel-supporting cylinder thereby maintaining the proper positional relationship between the bearing portion of the die and the sizing portion of the mandrel, the billet thereupon being extruded through the annular interstice defined between the bearing portion of the die and the sizing portion of the mandrel. The arrangement disclosed within the aforesaid first aspect permits the ready extrusion of tubes having walls or irregular or asymmetric configurations in cross section.

According to the second aspect of the present invention, there is provided a hydrostatic extrusion method and apparatus wherein a position-aligning member is adapted to restrict the movement of the rear portion of the mandrel with respect to the circumferential and axial directions thereof throughout the pressure-increasing and billet-extruding phases, thereby facilitating the extrusion of tubes having non-circular, inner and outer wall configurations in cross section.

According to the third aspect of the present invention, there is provided a hydrostatic extrusion method and apparatus wherein the mandrel includes a head portion which is brazed to the body portion, by using suitable brazing material which is soft and has a relatively low melting point, in a manner so as to provide a thin brazing layer between the head and body portions of the mandrel as well as in a manner in order to insure complete sealing for the brazed joint against the ingress of the billet being extruded, thereby preventing any yield of the brazed joint. In this respect, the head portion of the mandrel includes the combination of the sizing portion, the intermediate portion, the sealing portion and part of the body portion of the mandrel which part is continuous with the sealing portion.

According to the fourth aspect of the present invention, there is provided a hydrostatic extrusion method and apparatus wherein the mandrel includes an intermediate portion having a substantially reduced diameter whereby the flow of the billet will not contact such intermediate portion of the mandrel, whereby the billet may effect free sinking within the range defined between the sealing portion and the sizing portion of the mandrel.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein:

FIG. 1 is a longitudinal cross-sectional view of the forward portion of a conventional extruder, and showing the arrangement of the die, billet and mandrel within the container of the extruder;

FIG. 2 is a longitudinal cross-sectional view of the forward portion of an extruder constructed according to the present invention, and showing the arrangement of the die, billet and mandrel within the container of the extruder;

DETAILED DESCRIPTION OF THE PREFERRED EMBODIMENTS

Figure 3A:
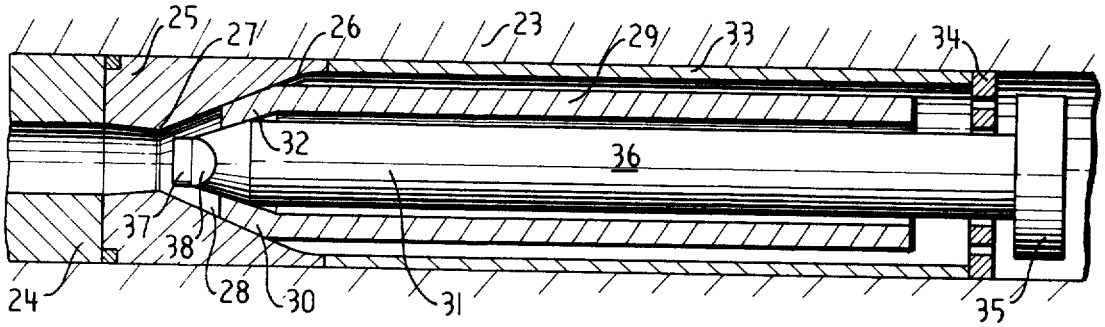
FIGS. 3A and 3B are longitudinal cross-sectional views of another embodiment of an extruder, taken along the horizontal and vertical axes thereof, constructed according to the present invention, such extruder being adapted to extrude a tube having a substantially flat circumferential wall.

In order to better understand the present invention, the definitions of the various terminology employed herein will initially be provided:

a. Forward or a forward direction is the direction in which the billet is being extruded, and in connection with such, the terms, "head portion" and "nose portion" are also used but these terms too are employed so as to further define the forward direction as defined herein.

b. The conical cavity of the die is the space or chamber within the die which is defined by the inner, conical surface of the die which is convergent in the forward direction toward the longitudinal axis of the die.

C. The bearing portion of the die is the portion which finally governs the outer configuration of the tube to be extruded, that is, the most forward or tip portion of the die which has a substantial length in the axial direction.

d. The approach portion of the inner, conical, surface of the die is the rear-half portion of the inner, conical surface of the die which is adapted to initially introduce the billet nose or tip into the die cavity or to retain the billet nose in cooperation with the sealing portion of the mandrel for the sealing purposes noted heretofore. In this respect, the aforesaid term, "rear-half" is not used in a limiting sense but merely for facilitating an understanding of the positional function of the approach portion of the inner conical surface of the die. In addition, the forward-half or remainder of the inner, conical surface of the die need not necessarily be of a conical configuration. Still further, the terms, "first and second approach portions" as used in the specification merely refer to such "approach portion" and "remainder portion" as respectively defined herein.

e. The sizing portion of the mandrel is the tip or forward portion of the mandrel which governs the configuration of the inner, peripheral surface of the tube to be extruded and which has a substantial length in the axial direction of the mandrel.

f. The sealing portion of the mandrel is the rear-half portion of the frusto-conical outer peripheral surface of the mandrel, except for the sizing portion, which is continuous with the body or shank portion of the mandrel. In this respect, the sealing portion of the mandrel cooperates with the approach portion of the die for initial sealing with respect to the pressure medium. Likewise, the aforesaid term "rear-half" is not used in a limiting sense but merely for a better understanding of the positional relationship of the mandrel sealing portion relative to the entire frusto-conical, outer peripheral surface of the mandrel.

g. The intermediate portion of the mandrel is the portion integrally interposed between the sizing portion and the sealing portion of the mandrel. This portion provides the surface or surfaces which accomodates the flow of the billet through the annular interstice defined between the sizing portion of the mandrel and the bearing portion of the die. Thus, for extrusion of a tube having circular inner and outer walls, the intermediate portion assumes a simple frusto-conical surface continuous with the sizing and sealing portions of the mandrel. However, for extrusion of a tube having, for example, two bores extending therethrough, the intermediate portion would be bifurcated into two portions so as to smoothly guide the billet flow toward the two sizing portions of the mandrel. Thus, the intermediate portion may assume any desired configuration, commensurate with the desired configuration of the bore or bores extending through the tube to be extruded.

h. The preliminary sealing refers to the sealing effected between the forward edge of the inner peripheral surface of the billet, the corresponding portion of the sealing portion of the mandrel and the corresponding portion of the approach portion of the die. In this case, the frusto-conical inner, peripheral surface of the billet has, in its cross section, an inclined angle greater than or equal to that of the sealing portion of the mandrel with respect to the axial center line of the mandrel, thus presenting a considerably reduced contacting surface area therebetween, rather than line contact, while the frusto-conical, outer peripheral surface of the billet has an inclined angle less than or equal to that of the approach portion of the die defining the die cavity thereby insuring positive sealing therebetween. In addition, the initial sealing refers to the sealing effected by further advancing the mandrel a small distance so as to thereby cause such initial sealing and insure positive sealing between the approach portion of the die defining the die cavity and the frusto-conical, outer peripheral surface of the billet and between the frusto-conical peripheral surface of the billet and the sealing portion of the mandrel, respectively, whereupon extrusion of the billet may then proceed.

i. The head portion of the mandrel is defined as including the sizing portion, the intermediate portion, the sealing portion, and part of the body portion of the mandrel which part is continuous with the sealing portion.

j. Free-sinking of the billet is the manner in which the billet is extruded, without contacting the intermediate portion of the mandrel, for the purpose of maintaining only a thin fluid film between the mandrel and the billet.

Referring now to the drawings and more particularly to FIG. 2 thereof, there is illustrated one embodiment of an extruder constructed according to the present invention, wherein a container 11 has a die 13, supported by means of a die supporting body 12, disposed within the forward hollow, portion thereof. Disposed in turn within the conical cavity of the die 13 is the nose or forward portion 15 of an annular billet 14 and similarly disposed within billet 14 is a mandrel 17, the forward conical portion of mandrel 17 being seated within the nose portion of billet 14 and partially passing through the opening provided therein, while the rear end is affixed to a mandrel ring 16 which is slidably disposed within container 11. The mandrel 17 consists of a sizing portion 19 having a solid cylindrical configuration and a diameter less than that of body portion 21, portion 19 governing the inner diameter of the tube to be extruded in cooperation with the bearing portion 18 of die 13. An intermediate portion 19' is interposed between sizing portion 19 and a frusto-conical sealing portion 20 of the mandrel 17 which is in continuous or integral relation with respect thereto, with the sealing portion 20 also being continuous with the cylindrical body portion 21 of the mandrel 17. An annular mandrel supporting cylinder 22 is disposed within the container 11 and the forward end of cylinder 22 abuts the rear end of die 13.

When the pressure within the container 11 is increased due to the advancement of a stem, not shown, from a position as shown in FIG. 2, then the mandrel 17 will advance together with the mandrel ring 16 until the forward face of the mandrel ring 16 abuts the rear face of the mandrel supporting cylinder 22. At this time, the sizing portion 19 of mandrel 17 is disposed within the bearing portion 18 of die 13 thereby defining an annular interstice therebetween which governs the cross-sectional shape of the tube to be extruded. It is additionally noted that the billet 14 sealingly contacts the outer conical surface of mandrel 17 with the tip of billet 14 being positioned behind the mid point of the aforesaid conical portion 20, the axial extent of such portion being denoted L, and in addition sealingly contacts the inner conical surface of the die 13 defining the conical die cavity. It should be noted further that the configuration of the nose of the billet is frusto-conical rather than the sharp edge of the conventional billet, and thus the preparation of the tip portion of the billet requires less machining and manufacturing processes.

When the mandrel advances during the time when the internal pressure of the pressure medium is being increased, the conical sealing portion of the mandrel will act in a manner tending to enlarge the nose portion of the billet, in a radially outwardly direction, whereby the outer peripheral surface of the billet will be urged against the inner conical surface of the die whereupon the desired initial sealing for the extrusion may be achieved. When the pressure within container 11 reaches a predetermined value, the billet 14 will be extruded into a tubular form through the annular interstice defined between the bearing portion 18 of die 13 and the sizing portion 19 of mandrel 17. While questions may arise as to the necessity for a considerable pressure increase in order to extrude the billet due to the initial sealing effected along the tapered or conical portion of the mandrel rather than along the tip portion of the mandrel, the maximum pressure for extrusion in practical application proved not to be excessive, as shown in Table 1, the results of the experiments proving no substantial rise in the break-through pressure, and thus reflecting the advantages of the simplified preparation of the billet nose portion to a frusto-conical configuration according to the present invention.

TABLE 1

| Billet Material designation | Dimension (mm) | Dimension of tube (mm) | Extrusion pressure | Extrusion ratio |
|---|---|---|---|---|
| Al 1100 | 340×100 | 3.90×0.52t | 8500 | 150 |
| " | " | 3.90×0.43t | 8770 | 177 |
| Al 3003+7072 | 340×210 | " | 7600–7400 | 46.6 |
| " | " | " | 7900–7450 | " |

Figure 3B:
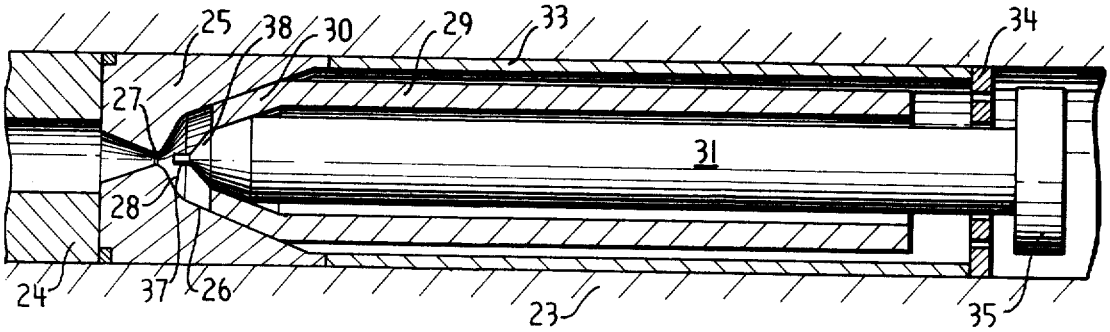
Figure 4A:
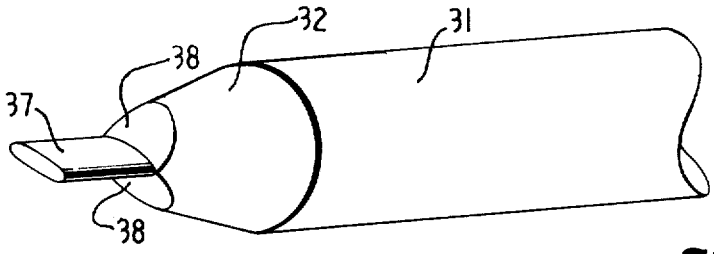
FIGS. 4A and 4B are respectively, a perspective view of the mandrel and a longitudinal cross section of the billet utilized within the extruder of FIGS. 3A and 3B.
Figure 4B:
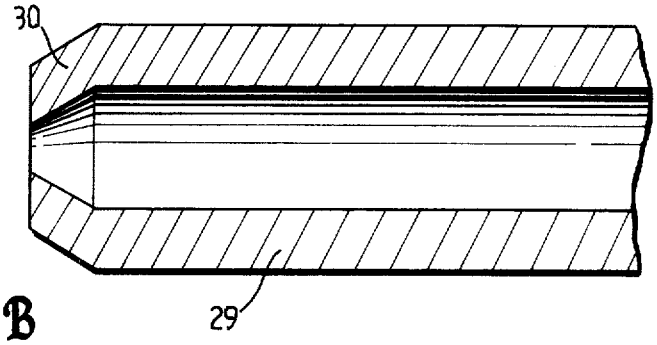

Referring now to FIGS. 3A and 3B, there is shown an embodiment of the present invention for extruding a billet as seen in FIG. 4B, into a flat tubular form. The container 23 has disposed within the forward, hollow portion thereof the die 25 which is supported by means of a die-supporting body 24. The die is formed with a first approach portion 26 having an inner conical surface and a bearing portion 27 disposed forwardly of portion 26 and having an opening the configuration of which conforms to the outer configuration of the tube to be extruded, and a second approach portion 28 having sloped surfaces which extend parallel with the major axis of the opening of the flat circular configuration within the bearing portion 27 of the die 25. The outer peripheral surface of the nose portion 30 of the annular billet 29 sealingly contacts the first approach portion 26 of die 25 while the inner peripheral surface of the nose portion 30 of billet 29 sealingly contacts the conical sealing portion of mandrel 31, respectively.

A mandrel-supporting cylinder 33 is disposed within container 23 and has its forward face in abutment with the rear face of the die 25. Abutting the rear face of the mandrel-supporting cylinder 33 is the forward face of mandrel ring 34 which has a central through-hole of a diameter smaller than that of the large diameter rear end portion 35 of the mandrel 31 yet large enough so as to permit the body portion 36 of the mandrel 31 to be slidably disposed therethrough. The mandrel 31 includes a sizing portion 37 within the tip portion thereof as best seen in FIG. 4, a conical sealing portion 32 disposed rearwardly of the sizing portion 37, and sloped flat surfaces 38 upon portion 32 which extend parallel with the major axis of the sizing portion which has a substantially flat elliptical cross-section, the aforesaid sizing portion 37 having a configuration which of course conforms to the inner configuration of the tube to be extruded and being of such size as to be inclined within a circle having a diameter smaller than that of the diameter of the sealing portion 32 at its forward end.

The condition of the container 31 prior to the pressure increase therewithin is shown in FIGS. 3A and 3B, while the mandrel and billet are respectively shown in FIGS. 4A and 4B. When a stem, not shown, is advanced so as to thereby increase the pressure within the container 23, then the mandrel will advance until the forward surface of the large diameter portion 35 of mandrel 31 abuts the rear face of mandrel ring 34 whereupon forward progress of mandrel 31 is terminated. At this time, the sizing portion of the mandrel has been positioned relative to the bearing portion 27 of the die 25 whereby an annular interstice is defined by means of the sizing portion 37 of mandrel 31 and the bearing portion 27 of die 25 so as to govern the final configuration of the tube to be extruded.

When mandrel 31 advances during the pressure increasing step of the extrusion process, the conical sealing portion 32 of the mandrel 31 will act in a manner tending to enlarge the inner conical surface of the nose portion 30 of billet 29 in the radially outward direction thereby imparting intimate contact or sealing between the sealing portion 32 of the mandrel and the nose portion 30 of billet 29 and similarly with respect to the outer peripheral surface of the nose portion 30 of billet 29 which is pressed against the conical, first approach portion 26 of die 25. When the pressure within the container 23 is raised still further, billet 29 is extruded through the interstice defined between the bearing portion 27 of die 25 and the sizing portion 37 of mandrel 31 into a flat tubular form.

In this respect, the angle of the outer conical surface of the nose portion 30 of billet 29 as shown in FIG. 4 should preferably be slightly smaller than that of the first approach portion 26 of die 25, while the angle of the conical surface of sealing portion 32 of mandrel 31 is approximately 20° smaller than that of the conical portion of the first approach portion 26 of die 25, as shown in FIGS. 3A and 3B so as to achieve satisfactory initial sealing.

It should be recognized that according to the present invention, the initial sealing attained between the mandrel, billet and die is effected between the sealing portion of the mandrel which extends forwardly of the body portion thereof, and the inner conical surface of the billet, and between the outer conical peripheral surface of the billet and the inner conical surface of the die, that is, the first approach portion 26, but within the range or extent not beyond the sealing portion 32 of the mandrel such that sealing may be achieved irrespective of the configuration of the sizing portion 37 of the mandrel, such as for example, an ellipse or a configuration providing a multi-hole tube.

Figure 5:
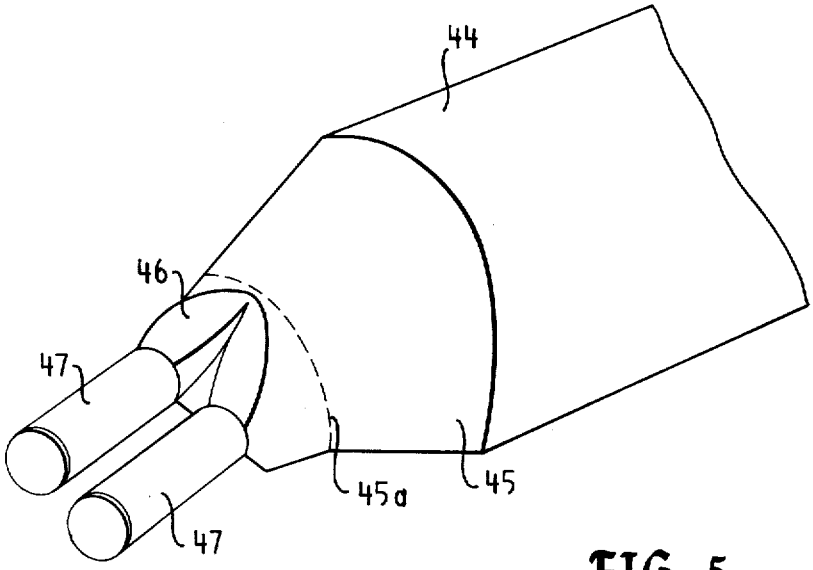
FIG. 5 is a perspective view of the head portion of a mandrel having two solid, cylindrical cores adapted to provide two through-holes within a tube to be extruded, the cores serving as the sizing portions of the mandrel according to the present invention.
Figure 6:
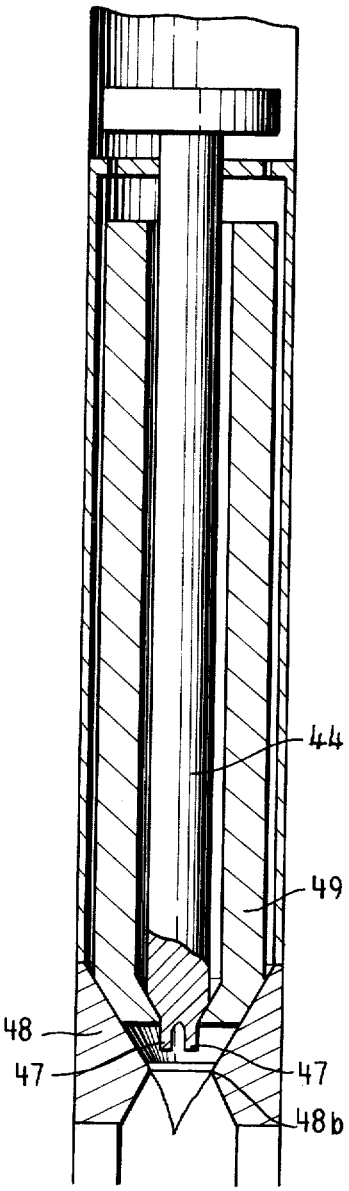
FIG. 6 is a view similar to that of FIG. 2 showing however another embodiment of the present invention wherein the mandrel as shown in FIG. 5 is utilized.

Turning now to FIGS. 5 and 6, another embodiment of the present invention is disclosed whereby the extrusion of a multi-hole tube is facilitated. In FIG. 5, there is shown a mandrel for use in the hydrostatic extrusion apparatus according to the method of the present invention, a frusto-conical sealing portion 45 being integrally provided with the body portion 44 of the mandrel and being positioned forwardly thereof, such frusto-conical sealing portion 45 having a maximum diameter which is equal to that of the body portion and a minimum diameter which is shown by the dotted line **45*a* thereby forming the frusto-conical sealing surface 45. Surface 45 is adapted to abut the inner peripheral surface of the nose portion of the hollow billet and integral with, but forwardly of, the frusto-conical sealing portion 45 of mandrel 44 is a divided portion 46 which bifurcates from the minimum diameter portion 45*a* of the frusto-conical sealing portion 45**.

The configuration of the bifurcated portion 46 is well adapted for the flow of the billet under the extrusion pressures and in accordance with the desired thickness of the final product to be extruded, and thus, it facilitates a smooth extrusion of the billet. Extending axially forwardly of, but integral with, the bifurcated portion 46 are two projecting cores 47 having a solid cylindrical configuration and a diameter which is substantially less than that of the body 44. The projecting cores 47 of course govern the internal configuration of the final extruded product, and in this instance, such product will be a tube having two through-holes therein as shown. In FIG. 6, the relationship between the die 48, the annular billet 49, and the mandrel 50 is illustrated at the time of completion of the initial sealing whereupon extrusion of the tubular form having two through-holes formed therein, by utilizing the mandrel as shown in FIG. 5, may then be performed. The initial sealing and extruding procedures are the same as in the case of extrusion of the substantially flat tube disclosed hereinbefore, and the annular billet 49 used in the extrusion within this embodiment has a configuration similar to that used within the extrusion of a tube having a circular cross section.

Thus, upon extrusion, the billet will be divided into two flows through means of the bifurcated portion 46 which is disposed rearwardly of the projecting core portions 47, the flows of the billet then being forced through the interstice defined between the outer-configuration-forming portion **48*b* of die 48 and the inner-configuration-forming portion, that is, the two projecting core portions 47 of the mandrel 44** for extrusion into a tubular form having two through-holes provided therein. As is best seen from the foregoing, a conventional annular billet having a frusto-conical tip or edge portion may be utilized for the hydrostatic extrusion of a tube having a plurality of through-holes therein, and consequently, a specially configured billet need not be prepared for such an extrusion process which would therefore otherwise have many additional difficulties associated therewith. In this manner, the extrusion may readily be achieved, and such an achievement may even be said to be an epoch in extrusion methods for multi-hole tubes. In addition, it should also be noted that the outer, cross-sectional configuration of the extruded tube need not necessarily be that of a circle, but may in lieu thereof be any other configuration, such as for example, an ellipse or a substantially flat circle, as desired or required.

Referring now to the second aspect of the hydrostatic extrusion method derived in accordance with the present invention, which is particularly applicable to the extrusion of a tube having a substantially flat circular cross section, a particular attempt has been made to prevent the rotation of the mandrel relative to the die as well as to maintain the relative relationship between the mandrel and the die throughout the pressure increasing phase of the pressure medium and the extrusion phase of the billet, thereby achieving satisfactory extrusion of a tube having a wall of a given asymmetric configuration in cross section. In addition, another attempt has been made in order to provide a position-aligning member of simple construction but nevertheless effective in its function so as to locate the mandrel relative to the die as desired.

There are three features characteristic of the second aspect of the hydrostatic extrusion method of the present invention, and they are summarized as follows:

I. The extruder comprises a die which is provided within the forward hollow portion of the container and is adapted to govern the external configuration of the extruded tube, a mandrel having a forward portion which governs the inner configuration of the tube extruded, and a position-aligning member which restricts the movement of the rear portion of the mandrel, whereby the circumferential movement or rotation of the mandrel may be controlled by means of such position-aligning member throughout the pressure increasing phase of the pressure medium within the container as well as within the extruding phase of the billet.

II. Elongation of the mandrel which occurs during extrusion under varying pressures may be compensated.

III. The position-aligning member is provided for association with the rear end portion of the mandrel-supporting cylinder and has axial grooves provided within the outer peripheral wall thereof and through-holes which provide communication between the interior and exterior portions thereof.

Figure 7A:
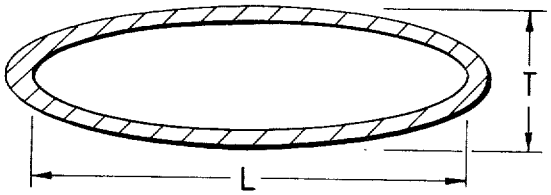
FIGS. 7A and 7B are transverse cross-sectional views of the circumferential walls of extruded tubes having irregular or non-circular configurations.

When extruding a billet having a circular cross section into a tubular product having an asymmetric or non-circular cross section according to hydrostatic extrusion methods, numerous difficulties have been experienced in preventing the rotation of the mandrel relative to the die due to the fact that local differences in the degree of plastic deformation accrue from the asymmetric or non-circular cross-sectional configuration of the die cavity thereby failing to present an extruded tube having a desired uniform wall thickness. In addition, in the instance of extrusion of a tube having an outer elliptical configuration in cross section, with the outer-configuration-forming portion having a minor axis T which is smaller than the inner configuration forming portion having a major axis L, as seen in FIG. 7A, discrepancies arise whereby the die and the sizing portion of the mandrel contact each other when the mandrel advances such that the position of the mandrel relative to the die is improperly and variably adjusted.

Figure 8:
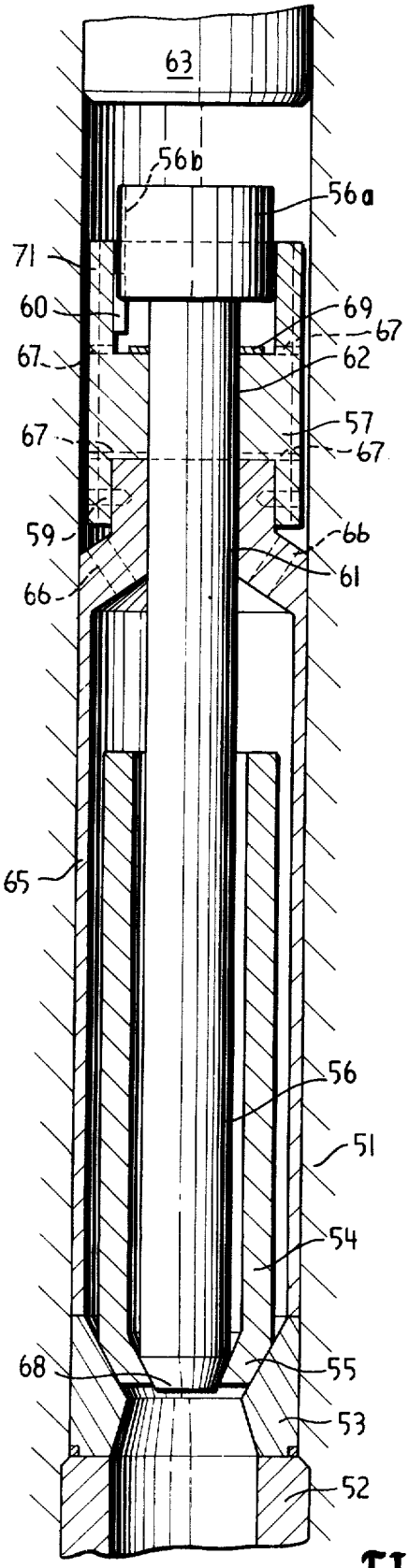
FIG. 8 is a view similar to that of FIG. 2 showing however still another embodiment of the present invention wherein a position-aligning member is utilized.

Turning then to FIG. 8, a fixed type mandrel extrusion apparatus for extruding a flat tube as shown in FIG. 1, is shown which may avoid the aforenoted shortcomings. In this FIGURE, the container is shown at 51, and an annular die 53, supported by means of a die supporting body 52, is disposed within the forward hollow portion of the container the opening within the die 53 governing the outer configuration of the tubes extruded. Abutting the inner conical surface of die 53 is the outer, conical, peripheral surface of the nose portion 55 of annular billet 54, the tip portion of a mandrel 56 in turn being in abutting relationshilp with the inner peripheral surface of nose portion 55. The movement of mandrel 56 is somewhat restricted, at its rear end portion, by means of a position-aligning member 57 which will be described in greater detail hereinafter, and it can readily be appreciated that the tip or sizing portion of the mandrel 56 governs the inner configuration of the extruded tubes. The position-aligning member 57 is coupled to the rear end of a mandrel supporting cylinder 65 whereby the circumferential rotation of the mandrel 56 will be prevented during both the pressure increasing phase or the extrusion phase of the process, yet nevertheless permitting the axial movement in the extrusion direction of the mandrel 56 during the pressure increasing phase.

More particularly, the mandrel supporting cylinder 65 has a forward portion which contacts the rear face of die 53 and a rear, axially extending coupling portion which is disposed within a recessed portion of the position-aligning member 57 and secured therein by means of a plurality of suitable fastening members 59, such as for example, screws or pins, which are adapted to extend through the position-aligning member 57 and the cylinder 65 in the radial direction. The mandrel 56 is inserted through an axial bore of member 57 from a position disposed rearwardly thereof, the outer peripheral surface of the rear, large-diameter portion **56*a* of the mandrel 56 being formed with an axially extending groove 56*b* which is adapted to cooperate with a key 60 formed upon the inner surface of another recessed portion defined within the rear portion of member 57**.

The mandrel 56 contacts the position-aligning member 57 through means of the internal surface 62 defining the axial bore therein, and similarly contacts the mandrel supporting cylinder 65 through means of the internal surface 61 likewise defining the axial bore therein, such that the rotation of the position-aligning member 57 or the mandrel 56 provides angular adjustment of the mandrel 56 relative to the die 53, the provision of key 60 and groove **56*b*, in combination, permitting only axial movement of mandrel 56. Furthermore, the final angular adjustment of mandrel 56 relative to die 53 is attended to by means of the aforesaid fastening means 59, while the circumferential rotation of mandrel 56, throughout the pressurizing and extrusion phases may be prevented by means of key 60 and key groove 56*b*. Alternative means for aligning the position of mandrel 56 relative to die 53 may of course be apparent, such as for example, machining the contacting interfaces 61 and 62 so as to have square configurations in cross section thereby permitting the axial movement of mandrel 56 although preventing circumferential rotation thereof. Furthermore, for a still further alternative means of this kind, die 53 may be initially rotated for positionally-aligning the mandrel 56** relative thereto and subsequently fixing the die at the desired position.

The lateral deflection of the mandrel 56, such as for example as may be caused by locally varying deformation-resistance unique to the extrusion of tubes having an asymmetric or non-circular configuration in cross section, may be eliminated by rendering the areas of the interfaces 61 and 62 as large as possible to the extent that machining considerations will allow. In addition, it is mandatory for achieving stable hydrostatic extrusions of tubes having an asymmetric or non-circular configuration in cross section that a proper relationship be maintained between the bearing portion of the die and the sizing portion of the mandrel, that is, the radial spacing between the two members, or in other words, the axial positional relationship therebetween. Still further, as the extrusion pressure is largely dependent upon the deformation resistance of the billet as well as the extrusion ratio, even in the instances of extruding asymmetric-cross-sectional tubes having similar inner configurations, the extrusion pressures will vary in accordance with the deformation resistances of the billets. It follows therefore that in the instance of extrusion of tubes having the same inner configurations and wherein the same type mandrel is employed, the mandrel will be subjected to varying extrusion pressures depending upon the deformation resistances of the billets. As a result, the axial elongation of the mandrel varies in accordance with the variation in extrusion pressure.

The embodiment shown contemplates the compensation for such an elongation of the mandrel and hence the positional relationship between the bearing portion of the die and the sizing portion of the mandrel. To this end, according to the present invention, there is provided an annular, mandrel position-adjusting spacer 69 which is interposed between the rear large-diameter portion 56*a* of the mandrel and the rear face of the positional-aligning member 57. The axial position of the mandrel may be estimated by considering the extrusion pressure, which may be determined by the deformation resistance of the billet and the extrusion ratio, in addition to the elastic elongation of the mandrel under such pressure. Accordingly, the spacer interposed between the rear face of position-aligning member 57 and the rear, large-diameter portion 56*a* of the mandrel is so designed as to bring the sizing portion 68 of the mandrel to a desired position relative to the die.

With such an arrangement of this embodiment of the present invention, a stem 63 is advanced so as to raise the pressure of the pressure medium within the container 51 whereupon attaining a predetermined value, billet 54 will be extruded through the interstice or gap defined between the die 53 and the mandrel 56. It must again be remembered that it is of supreme importance that the positional relationship between die 53 and mandrel 56 be properly maintained, and most important, is the consideration of the elastic deformation of the mandrel under the high pressures.

The strain $\epsilon_1$ of a material under a three-dimensional stress condition can be expressed as follows:

$$\epsilon_1 = \frac{\sigma_1}{E} - \frac{\nu}{E}(\sigma_2 + \sigma_3) \quad (1)$$

wherein E represents the elastic modulus, $\nu$ represents Poisson's ratio, and $\sigma_1$, $\sigma_2$ and $\sigma_3$ represent the principal stresses.

If it is assumed that the diameter of mandrel 56 be represented as $d_o$, the outer diameter of mandrel supporting cylinder 58 as $D_1$, the force component in the extruding direction, of the friction force created between mandrel 56 and billet 54 as F, and the pressure within container 51 as P, then the principal stresses applied to the mandrel 56 will be represented by the following formulae:

$$\sigma_1 = F/\left(\frac{\pi}{4}d_o^2\right) = \frac{4F}{\pi d_o^2} \quad (2)$$

$$\sigma_2 = -P \quad (3)$$

$$\sigma_3 = -P \quad (4)$$

When formula (1) is combined with formulae (2), (3) and (4), the strain $\epsilon_m$ of mandrel 56 will be expressed as follows:

$$\epsilon_m = \frac{1}{E}\left(\frac{4F}{\pi d_o^2} + 2\nu P\right) \quad (5)$$

On the other hand, principal stresses $\sigma'_1$, $\sigma'_2$, and $\sigma'_3$ applied to the mandrel supporting cylinder 58 may be as follows:

$$\sigma_1' = P - \frac{d_1^2 P + F}{D_1^2 - D_2^2} \quad (6)$$

$$\sigma_2' = -P \quad (7)$$

$$\sigma_3' = -P \quad (8)$$

When formula (1) is combined with formulae (6), (7) and (8), then th strain $\epsilon_s$ of the mandrel supporting cylinder 58 will be obtained as follows:

$$\epsilon_s = -\frac{P}{E}\left(1 + \frac{d_o^2 + E/P}{D_1^2 - D_2^2}\right) + \frac{2\nu P}{E} \quad (9)$$

The displacement $\delta$ of the tip mandrel 56 will then be given as follows, with the proviso that the length of the mandrel supporting cylinder 58 is approximately equal to the length of mandrel 56:

$$\delta = (\epsilon_m - \epsilon_s)L \quad (10)$$

When formula (1) is combined with formulae (5) and (9), the following equation results:

$$\delta = \frac{L}{E}\left(\frac{4F}{\pi d_o^2} + P + \frac{d_1^2 P + F}{D_1^2 - D_2^2}\right) \quad (11)$$

Figure 7B:
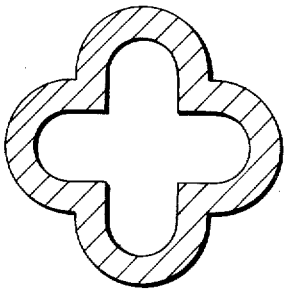
Figure 19:
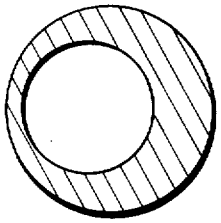
FIG. 19 is a transverse cross-sectional view of an extruded tube having an eccentric through-hole provided therein.

It follows from this that the small diameter portion 68 or the tip of the mandrel 56 may be located at a desired position by estimating the extrusion pressure P from the deformation resistance of the billet and the extrusion ratio, whereby the displacement $\delta$ of the tip of mandrel 56 will be determined, and thus a spacer 69 having a thickness equal to $\delta$ may be inserted in the aforenoted manner. In such case, the provision of the spacer having a thickness equal to $\delta$ will result in the mandrel being positioned to the rear of the bearing portion of the die by a distance of $\delta$. However, the initial sealing will be effected in a satisfactory manner if the configuration of the nose portion of the billet is altered to a slight degree due to the fact that the initial sealing is effected along the entire conical extent of the mandrel, that is, within the range encompassed by the large diameter portion $d_O$ to the small diameter portion $d_1$ thereof. As a result, in accordance with the present invention, tubular products having various cross sectional configurations, including those shown in FIGS. 7A and 7B, and of a given inner diameter, may be extruded by using a single mandrel under varying extrusion conditions at a relatively low extrusion pressure, yet resulting in the generation of an inner surface of high quality. In the same manner, as additionally shown in FIG. 19, a tube may be extruded having an eccentrically located through-hole.

Figure 9:
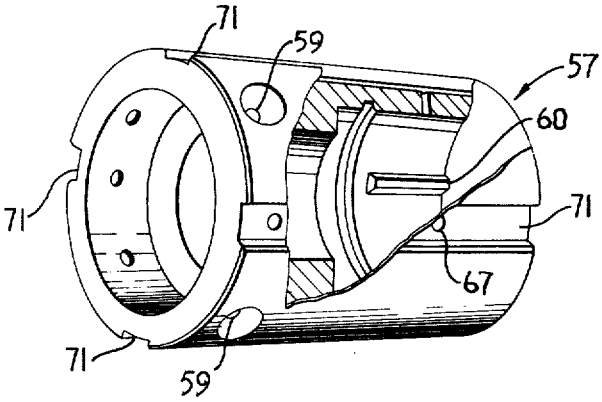
FIG. 9 is a perspective, enlarged view of the position-aligning member utilized within the extrusion apparatus of FIG. 8.

Continuing further, it is also of supreme importance that upon proceeding with the hydrostatic extrusion, the pressure within container 51 be uniform throughout the interior extent of the container, even from the viewpoint of service life, and thus a smooth flow of the pressure medium should result in the direction toward the die especially within the region ahead of the stem 63. To this end, there is provided a plurality of through-holes adapted to provide a smooth flow of the pressure medium from the stem side of the aligning member 57 to the die side thereof. Referring more particularly to FIG. 9, there is shown a perspective view of the position aligning member 57 of FIG. 8, a plurality of axially extending grooves 71 being provided upon the outer circumferential surface of position-aligning member 57 such that the pressure medium upon the stem side of member 57 may flow through passages 71 to the die side thereof.

In addition, there is also provided several through-holes 66 and 67 extending through mandrel supporting cylinder 65 and position-aligning member 57, respectively, for facilitating such flow, it being recalled that as the mandrel 56 extends through the mandrel supporting cylinder 65 and the position aligning member 57 so as to cooperate with the interfaces 61 and 62, respectively, for preventing the lateral displacement of the mandrel 56, the flow of the pressure medium therethrough would otherwise be blocked. Consequently, when the pressure medium compressed by the large-diameter portion **56*a* of mandrel 56, due to the axially forward movement of the mandrel relative to the position-aligning member 57, such medium may be bled through the through-holes 67 and 66 and toward the die, it being appreciated that the through-holes 67 are in fluidic communication with grooves 71. Such an arrangement may of course also prevent the structural failure of the position-aligning member 57** which would normally occur due to the generated pressure differential, such in turn imparting damage to the inner wall of the container.

The initial sealing among die 53, billet 54 and mandrel 56 may be attained in a manner similar to that described in detail with reference to the first aspect of the invention. Still referring to FIGS. 8 and 9, as the pressure within the container is increased, the mandrel will be prevented from traversing any rotational movement due to the cooperation between the key 60 and the key groove **56*b* while the axial positional adjustment of the mandrel relative to the die may be achieved by means of the spacer having a thickness equal to the displacement of the tip of the mandrel as has been discussed heretofore. In summary, such structure permits the axial movement of the mandrel which is thus made ready for the extrusion step of the process, with the axial position thereof being thus adjusted as desired for elongation compensation, and in addition, the mandrel 56 is also restricted, by means of the position-aligning member 57, from any circumferential rotation thereof. Consequently, under such conditions, a billet is able to be extruded through the interstice defined between die 53 and mandrel 56, the outer configuration of the tubes to be extruded being governed by means of the die 53 and the inner configuration of the tubes being governed by means of the mandrel 56. It is preferable that the key 60 be engaged with the key groove 56*b* prior to the mandrel 56** being advanced axially due to the increase in the pressure within the container.

Figure 10:
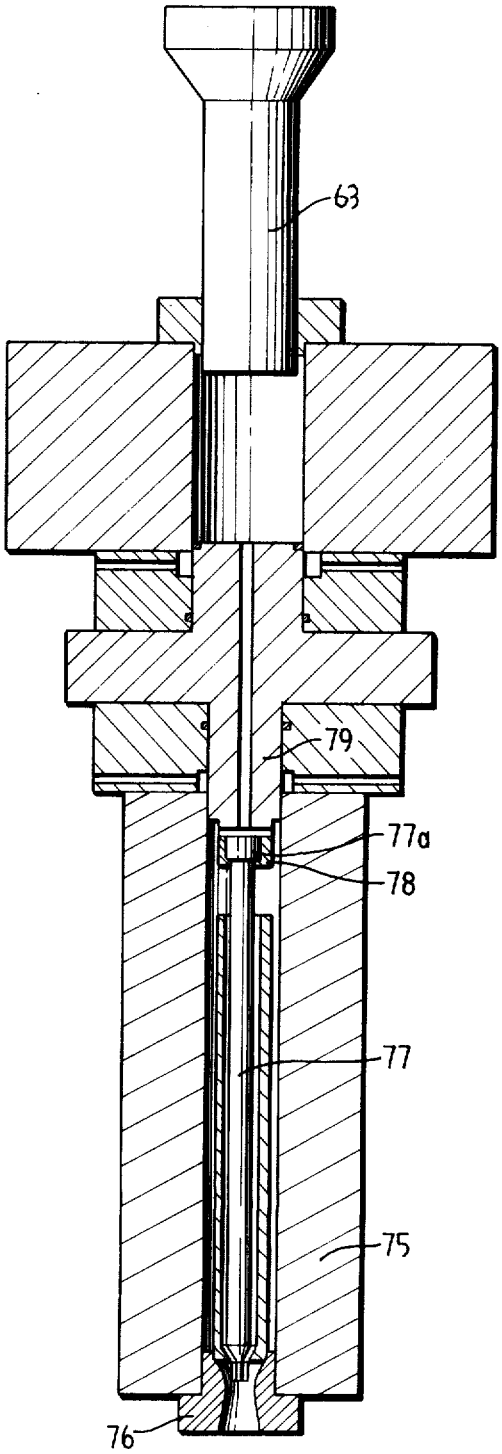
FIG. 10 is a view similar to that of FIG. 2 showing however yet another embodiment of the present invention wherein a tandem container type hydrostatic extruder is utilized.

Referring now to FIG. 10, there is illustrated a tandem container type hydrostatic extruder within which a mandrel 77 is fixedly disposed within a cylinder 75. A position-aligning member 78 is provided and is previously adjusted for a particular angular relationship with respect to a connecting cylinder 79. The position-aligning member 78 thus permits the axial movement of mandrel 77 through cooperation with the rear end large-diameter portion **77*a* of mandrel 77, and consequently, although the die 76 is fixed with respect to container 75 directly or indirectly, the positional adjustment of mandrel 77** is nevertheless possible.

A description will now be given of the third aspect of the present invention in which, for the extrusion of tubes according to hydrostatic extrusion methods, there is provided a mandrel whose head portion is exchangeable, thereby permitting a wide range of selection of materials to be used for the mandrel, with an accompanying considerable economy, while in addition allowing a wide range of selection of materials to be extruded. According to the third aspect of the invention, there is provided a mandrel consisting of a mandrel body and a mandrel head portion which is adapted to govern, in cooperation with the die, the cross sectional configuration of the tubes to be extruded, with the aforenoted head portion being in contact with the inner surface of the nose portion of the billet and of course being coupled to and a continuation of the mandrel body portion which extends in the axial direction. More particularly, the head portion may be brazed to the body portion of the mandrel by using a suitable brazing material which is softer and has a melting point lower than that of the material forming the head portion of the mandrel in such a manner as to result in a thin brazed layer therebetween whereby the joint between the head and body portions of the mandrel is sealed by the aforesaid brazed layer. In this respect, the joint of the two members is designed so as not to yield under transversely applied pressures and thrust forces, and such joint is particularly adapted for use in a fixed mandrel type hydrostatic extrusion apparatus.

Figure 11:
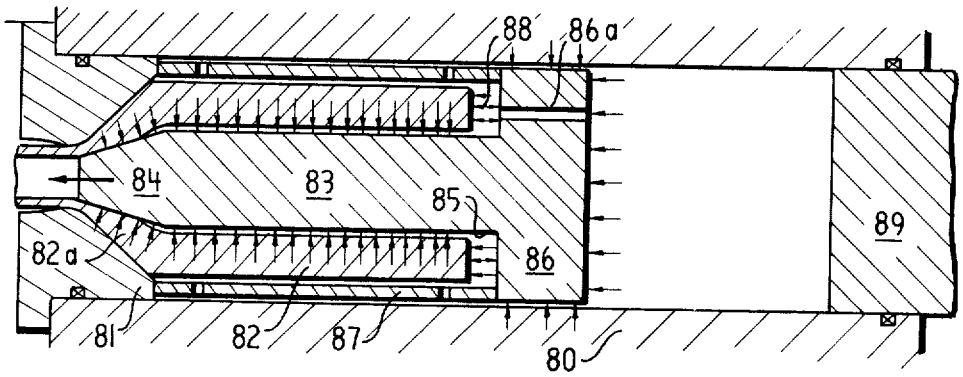
FIG. 11 is a view similar to that of FIG. 2 showing however a further embodiment of the present invention wherein a mandrel, whose head portion is replaceable, is utilized.
Figure 13:
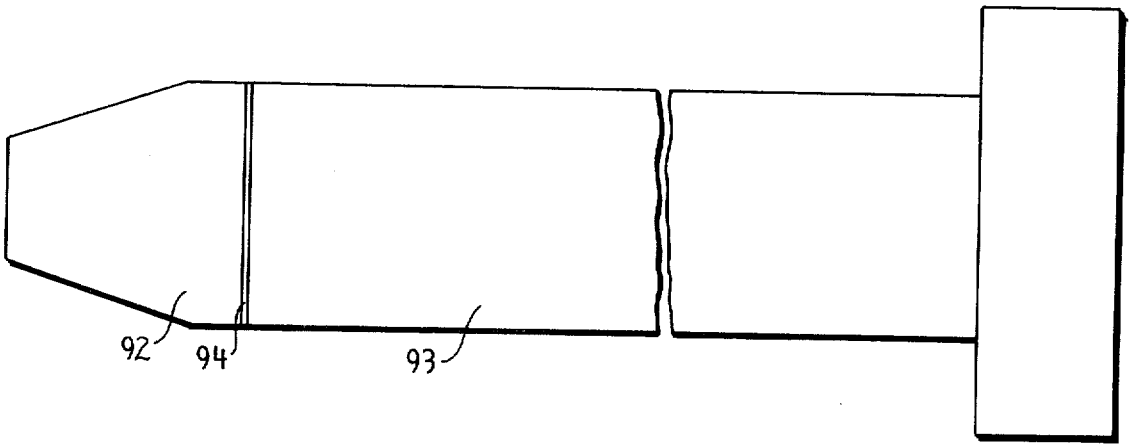
FIG. 13 is a schematic diagram of a mandrel wherein a replaceable head portion has been brazed to the body portion thereof.

Turning then to FIGS. 11 and 13, one embodiment of the present invention using this type of mandrel is shown, and for a better understanding of such a mandrel according to the present invention, a stress analysis will be discussed in detail after the detailed description of the construction of the fixed mandrel type hydrostatic extruder employing the mandrel of this type. Within FIG. 11, the pressure container 80 has disposed therein a die 81 and a tubular billet 82, a mandrel being inserted within billet 82 and including a body portion 83 and a large diameter portion 86, the boundary between portion 86 and the body portion of the mandrel being shown at 85. A mandrel supporting cylinder 87 is adapted to abut portion 86 and the pressure medium 88 is subjected to high pressure by means of the pressure ram or stem 89. With such an arrangement, upon extrusion, the mandrel portion 86 will be fixedly supported upon the mandrel supporting cylinder 87, and the advancing movement of the pressure stem 89 will cause a substantial increase in pressure within the pressure medium, whereby a high hydrostatic pressure P transmitted through a pressure transmitting hole 86*a* provided through the mandrel portion 86 will cause extrusion of the billet while the cross sectional configuration of the tube being extruded is governed by the aperture of the die 81 and the sizing portion 84 of the mandrel.

Figure 12:
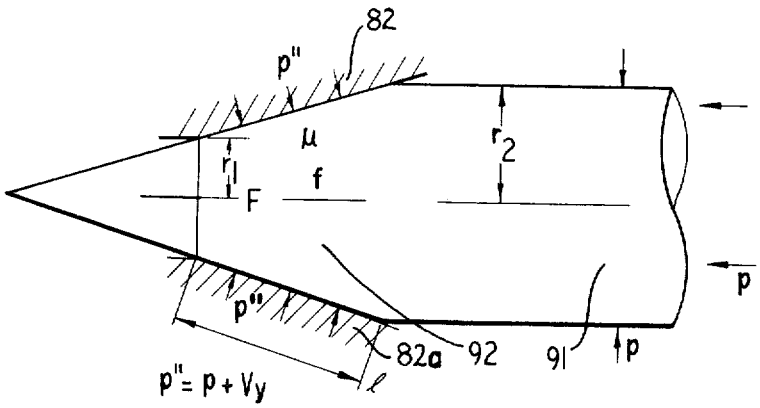
FIG. 12 is a schematic diagram illustrating the forces acting upon the head portion of the mandrel during pressurization of the system.

Referring now to FIG. 12, let us consider the forces acting upon the head portion 92 of the mandrel. For simplicity of description, suppose that the head portion 92 of the mandrel is tapered toward the tip or nose thereof and that the inner peripheral surface of the nose portion 82*a* of the billet 82 contacts the entire tapered, outer peripheral surface of the head portion of the mandrel, while the bearing pressure upon the interface between the mandrel and the billet is maintained to a constant value $(P + V_y)$, wherein P represents the aforesaid hydrostatic pressure, and $V_y$ represents a stress, in a vertical direction, acting upon the head portion of the mandrel, this stress being created by the compression of the nose portion 82*a* of the billet 82 between the head portion 92 of the mandrel and the die 81.

In this case, assume the apex angle of the tapered head portion 92 of the mandrel to be $2\alpha$, then the sum F of the friction forces acting in the axial direction, which act upon the entire tapered head portion 92 of the mandrel will be given as follows:

$$F = \int_{r_1}^{r_2} 2\pi\mu P \frac{r}{\tan\alpha} dr = \frac{\pi\mu(P+Vy)}{\tan\alpha}(r_2^2 - r_1^2) \quad (1)$$

wherein $\mu$ represents the coefficient of friction of the contacting surface of the mandrel, $r_1$ represents the radius of the tip end of the mandrel tip portion and $r_2$ denotes the radius of the mandrel body portion 83.

On the other hand, a force $f$, which acts in a direction opposite to the extrusion direction of the billet due to the contact with billet 82, also acts upon the tapered head portion 92 of the mandrel, and this force may be expressed as follows:

$$f = \pi (P + V_y)(r_2^2 - r_1^2) \quad (2)$$

The resultant force $F^x$ acting axially upon the head portion 92 of the mandrel upon extrusion, due to the contact with billet 82, may thus be given as a balance between the forces F and f as derived from the formulae (1) and (2):

$$F^x = F - f$$

$$= \pi (P + V_y)(r_2^2 - r_1^2)\left(\frac{\mu}{\tan\alpha} - 1\right) \quad (3)$$

As is clear from formula (3), the positive or negative sign of the axial resultant force $F^x$ is dependent upon the coefficient of friction $\mu$ and the tan $\alpha$, that is, the inclination of the tapered portion. For example:

If $\alpha > \tan^{-1}\mu$, then $F^x < 0$, that is, compression results

If $\alpha = \tan^{-1}\mu$, then $F^x = 0$, and

If $0 \quad \alpha \leqslant \tan^{-1}\mu$, $F^x > 0$, that is, tension results. (5)

In addition, the axial stress $\sigma$ acting upon the vertical cross section of the head portion of the mandrel due to the axial resultant force $F^x$ is obtained as a quotient of the resultant force $F^x$ divided by the cross sectional area, the absolute value thereof being a substantially small value as compared with the hydrostatic pressure P. (The inclined angle $\alpha$ is determined so as to approximate $\tan^{-1}\mu$, thereby giving $P >> \sigma$ ).

The present invention, as can thus be seen from the above analysis, is based upon the fact that the axial stress acting upon the head portion 92 and the body portion 93 of the mandrel is substantially small, as compared with the extrusion pressure. As shown in FIG. 13, the mandrel body portion 93 and the mandrel head portion 92 are separately formed and subsequently brazed together along the circumferential joint defined between the two members so as to thereby form the mandrel. As a result, the interior of the joint 94 is perfectly sealed from the external pressure medium. The mandrel head portion 92 and the mandrel body portion 93 are made of a high tension steel having a relatively high degree of toughness, and it is obviously noted that the materials used for this purpose should not yield due to the hydrostatic pressure and the axial forces acting thereon due to the hydrostatic extrusion. In addition, the head portion 92 of the mandrel is made of a metal which is the same as that of the mandrel body portion 93 or of a desired different material in an attempt not to cause yielding of the head portion 92 of the mandrel, as in the case of the mandrel body portion, under the hydrostatic extrusion conditions.

In contrast thereto, the brazing material for use in brazing the mandrel body portion 93 to the mandrel head portion 92 is softer and has a lower melting point, as compared with that of the material used for the head portion 92 and the body portion 93 of the mandrel. In such case, it is imperative that the thickness of the brazed portion be sufficiently small, while the yield of the brazing material may be suppressed by rendering the thickness thereof still smaller. Despite the fact that the material used for brazing is further susceptible to yielding, as compared with the materials used for the head portion 92 and the body portion 93 of the mandrel, the joint thus brazed can well withstand the yield stress under extrusion conditions. This is due in part to the so-called thin layer effect and partly because of the axial stress of a sufficiently samll magnitude as compared with the hydrostatic pressure. While the thickness of the brazed portion 94 should be varied depending upon the diameter of the mandrel, the thickness of the brazed portion 94 should preferably be small yet such as to nevertheless provide a bonding force sufficiently large so as to withstand the extrusion conditions.

Figure 14:
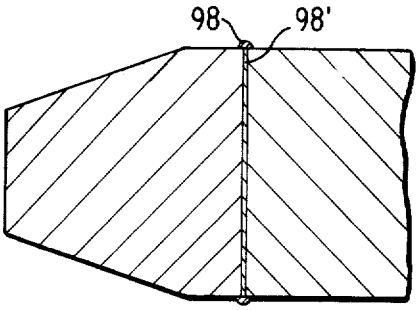
FIGS. 14, 15 and 16 are cross-sectional views of mandrels similar to that of FIG. 13, showing however, additional modes of securing the head and body portions togther.
Figure 15:
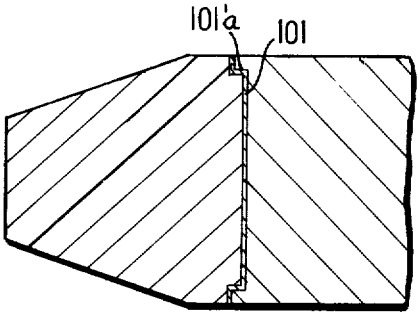
Figure 16:
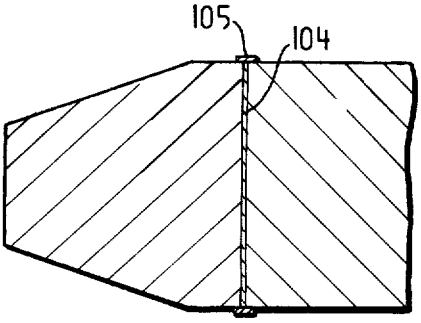

The types of joints and configurations of the joint surfaces of the two members should not necessarily be limited to those shown in FIG. 13. As shown in FIG. 14, brazing may be applied along the outer circumference 98 of joint 98' so as to render a built-up circumferential band therearound. In addition, as shown in FIG. 15, brazing may be applied to the joint surfaces 101', one of which has a built-up portion 101'*a* while the other of which has a recessed portion 101'*a* mating therewith. Still further, as shown in FIG. 16, a ring 105 of small thickness is brazed around the brazed portion 104, such ring being made of a high tensile strength steel. In short, even if the brazed layer appears to be thin, it may nevertheless satisfactorily join the mandrel body portion to the mandrel tip portion. The reason for using a brazing material for such purposes is to avoid unnecessary thermal deformation within the joint surfaces between the body portion and the tip portion of the mandrel.

As has been described, the fixed type mandrel is formed from a separate mandrel head portion and a separate mandrel body portion such that the mandrel head and body portions may be made of different materials which are well suited for their own particular purposes, with the accompanying advantages, such as for example, permitting replacement of the sizing portion, presenting considerable economy. Such of course contributes to a substantial reduction in the cost of the tools, that is, the mandrels not only undergoing maintenance and repair but also those being manufactured.

Referring now to the fourth aspect of the present invention, there is provided a hydrostatic extrusion method and apparatus which can impart a metallic type gloss to the inner surface or surfaces of the tube to be extruded at a relatively low extrusion pressure. Within this aspect, a reduced contact area between the billet and the bearing surface is contemplated so as to thereby minimize the inclusion of lubricant or oil between the aforesaid two members in an attempt to afford the particular finish characteristics to the inner surface of the tube to be extruded.

The initial sealing among the die, billet and mandrel is effected in a manner similar to that described hereinbefore with respect to the previous embodiments. More specifically, as the pressure within the container increases, the mandrel will be advanced until the gap between the inner peripheral surface of the frusto-conical surface of the die defining the die cavity and the outer frusto-conical surface of the sealing portion of the mandrel becomes substantially equal to the intended thickness of the tube to be extruded. In this case, the radial spacing between the intermediate portion of the mandrel and the inner peripheral surface of the die is much greater than the spacing between the aforesaid sealing portion of the mandrel and the inner peripheral surface of the die, such that as the pressure within the container is increased, the nose portion of the billet will advance into the gap defined between the die bearing portion and the sizing portion of the mandrel without contacting the intermediate portion surface of the mandrel. This type of flow of the billet is known as free sinking, and the space or chamber defined between the inner surface of the billet and that of the intermediate mandrel portion is designed so as to communicate with the atmosphere by means of an air passage extending through the sizing portion of the mandrel. Thus, if an excess of oil is entrapped within such space, the oil may be bled through the aforesaid passage to atmosphere. A more detailed description of such construction will be given with reference to the embodiments shown in FIGS. 17 and 18. In those figures, (A) and (B) respectively denote the initial sealing phase and the extrusion phase of the process.

Figure 17A:
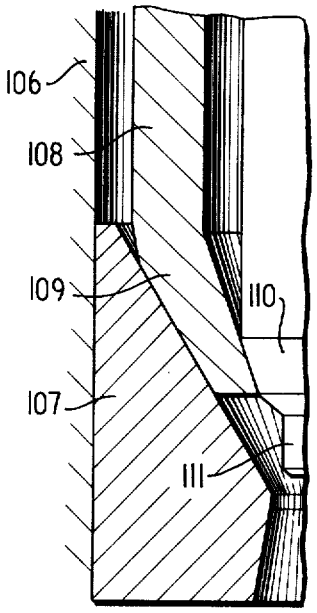
FIGS. 17A and 17B and 18A and 18B are views similar to that of FIG. 2, showing however a still further embodiment of the present invention wherein the intermediate portion of the mandrel has a substantially reduced diameter so as to permit free sinking of the billet.
Figure 17B:
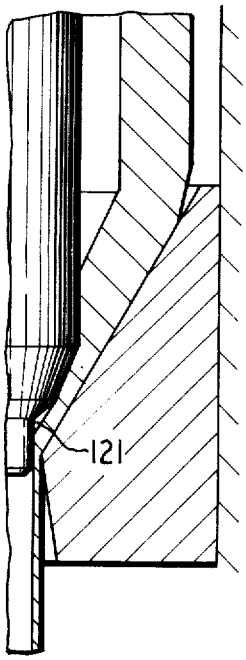
Figure 18A:
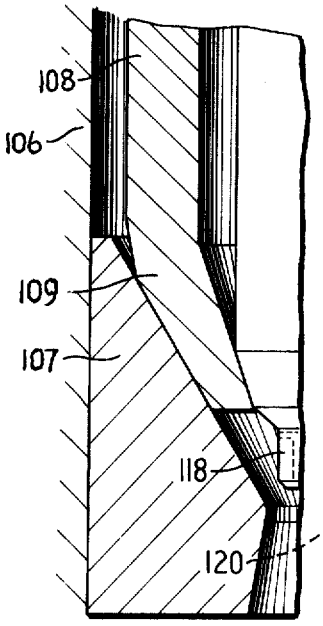
Figure 18B:
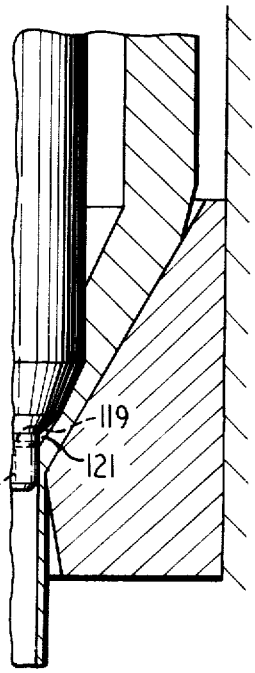

Referring first to FIGS. 17A and 17B, the container 106 is provided with a die 107 within the forward, hollow portion thereof. As in the previous embodiments, the nose portion 109 of the billet 108 is disposed between the inner peripheral surface of the die 107 and the sealing portion 110 of the mandrel, and in this case as well, the configuration of billet 108 is such as not to extend beyond the sealing portion of the mandrel. However, as shown in FIG. 17B, the contacting area between the billet 108 and the mandrel is extremely small as compared with the conventional extrusion apparatus as well as those of the previous embodiments of the present invention. This serves to minimize the intervention or inclusion of an excessive amount of the pressure medium or oil between the contacting surfaces of the mandrel and the billet 108. It follows from this, as has been described, that a smooth, finished inner surface upon the tube extruded may be obtained.

Nevertheless, it should be noted that even with the embodiment as shown in FIGS. 17A and 17B, some oil or pressure medium may become entrapped within the space defined between the inner peripheral surface of billet 108 and the outer surface of the intermediate portion of the mandrel, such occurrence thereby tending to spoil the desired appearance of the inner surface of the extruded tube. In order to rectify this situation, there is provided a fluid passageway which includes a radially extending passage 119 which communicates with the aforesaid space 121 and a second axially extending passage 120 which connects passage 119 with atmosphere, the entrapped oil thus being bled to atmosphere thereby maintaining the space 121 free of such fluid and thereby not adversely effecting the interior surface finish of the tube extruded.

As is apparent from the foregoing description, the novel arrangement of the nose portion of the billet, the cooperating inner surface of the die and the outer surfaces of the sealing and intermediate portions of the mandrel permit the extrusion of tubes having walls of any desired configuration, either internally or externally thereof, with a considerable concomitant cost savings in the preparation of the nose portion of the billet. In addition, according to the present invention, tubes of any desired configuration may be obtained by replacing or exchanging the head portion of the mandrel, thereby greatly contributing to the industrial production.

It should also be noted and recognized that, although the preparation of the billet appears simple, many complex and interrelated considerations and principles are involved in attaining the extrusions of the present invention, and such an approach to the extrusion of tubes having walls of asymmetric or non-circular configurations has not heretofore been attempted because of the aforesaid problems experienced within the prior art.

Obviously, many modifications and variations of the present invention are possible in light of the above teachings. It is to be understood therefore that within the scope of the appended claims the present invention may be practiced otherwise than as specifically described herein.

What is claimed as new and desired to be secured by Letters Patent of the United States is:

1. A hydrostatic extrusion method for tubes, wherein an annular billet is hydrostatically extruded through an annular interstice defined between the bearing portion of a die and the sizing portion of a mandrel, comprising the steps of:

preparing the nose or tip portion of said billet so as to have frusto-conical, inner and outer peripheral surfaces therefor, said frusto-conical inner peripheral surface of said billet having an inclined angle with respect to the axial line of said mandrel greater than or equal to that of a conical sealing portion of said mandrel, said frusto-conical outer peripheral surface of said billet having an inclined angle with respect to the axial line of said mandrel less than or equal to that of an approach portion of said die defining the die cavity, the inner diameter of said nose portion of said billet at its forward end being larger than the diameter of said sealing portion of said mandrel at its forward end and the smallest thickness of the nose portion of the billet along its length being larger than the thickness of the annular interstice defined between the bearing portion of the die and the sizing portion of the mandrel;

inserting said billet into a container of an extruder;

advancing said mandrel into the hollow central portion of said billet so as to effect a preliminary sealing between said approach portion of said die, said nose portion of said billet at the forward end thereof, and said conical sealing portion of said mandrel, so as to insure positive preliminary sealing;

further advancing said mandrel a small distance so as to thereby effect the initial sealing and to enhance the positive sealing between said approach portion of said die and said frusto-conical, outer peripheral surface of said billet and between the frusto-conical, inner surface of said billet and said sealing portion of said mandrel, respectively, whereupon the rear portion of said mandrel will abut a mandrel supporting means disposed within said container, thereby maintaining the proper positional relationship between said bearing portion of said die and said sizing portion of said mandrel; and extruding said billet through said annular interstice defined between said bearing portion of said die and said sizing portion of said mandrel.

2. A hydrostatic extrusion method as set forth in claim 1, further comprising:

providing said sizing portion of said mandrel with a non-circular cross section whose size is such as to be included within a circle having a diameter smaller than that of the diameter of said sealing portion of said mandrel at its forward end; and providing an intermediate portion of said mandrel with a non-circular cross section which serves to accomodate the flow of said billet into said interstice defined between said bearing portion of said die and said sizing portion of said mandrel, thereby presenting a tube having a non-circular cross sectional configuration.

3. A hydrostatic extrusion method as set forth in claim 2, further comprising:

providing said sizing portion of said mandrel with a plurality of small cylindrical cores, thereby presenting an extruded tube having a plurality of bores therethrough.

4. A hydrostatic extrusion method as set forth in claim 2, further comprising:

eccentrically disposing said sizing portion of said mandrel with respect to said bearing portion of said die, thereby presenting a tube having an eccentrically disposed bore therethrough.

5. A hydrostatic extrusion method as set forth in claim 2, further comprising:

providing a portion of the inner peripheral surface of said die, interposed between said approach portion and said bearing portion, with a non-circular cross section so as to cooperate with said intermediate portion of said mandrel in forming said tube having said non-circular configuration in cross-section, said portion being blended into said bearing portion and said approach portion at the forward and rearward ends thereof so as to facilitate smooth flow of said billet as the same is being extruded.

6. A hydrostatic extrusion method as set forth in claim 2, further comprising:

restricting the movement of the rear portion of said mandrel so as to maintain the axial and circumferential position of said mandrel throughout the pressure increasing and extrusion phases, thereby facilitating the extrusion of a tube having a wall of non-circular configuration in cross section.

7. A hydrostatic extrusion method as set forth in claim 2, further comprising:

providing said intermediate portion of said mandrel with a substantially reduced diameter-portion so as not to contact the inner surface of said billet during extrusion thereof and to define a space therebetween, thereby permitting free sinking of said billet.

8. A hydrostatic extrusion method as set forth in claim 7, further comprising:

providing passages within said mandrel so as to communicate said space formed between said intermediate portion of said mandrel and said inner surface of said billet with atmosphere, thereby alleviating any inclusion of fluid within said space.

9. Apparatus for hydrostatically extruding tubes from an annular billet adapted to be interposed between a die and a mandrel, the nose or tip portion of the billet being frusto-conical in configuration and including inner and outer peripheral surfaces, comprising:

a container;

a die disposed within said container and including a bearing portion; and a mandrel disposed within said container and including a sizing portion which cooperates with said bearing portion of said die so as to define therebetween an annular interstice through which said tubes are extruded;

the outer peripheral surface of a conical sealing portion of said mandrel having an inclined angle with respect to the axial line of said mandrel less than or equal to that of the inner peripheral surface of the billet to be used within said apparatus so as to facilitate sealing therewith, the inner peripheral surface of an approach portion of said die having an inclined angle with respect to the axial line of said mandrel greater than or equal to that of the outer peripheral surface of the billet so as to facilitate sealing therewith, the diameter of said sealing portion of said mandrel at its forward end being smaller than the inner diameter of the nose portion of the billet at its forward end, and the thickness of the annular interstice defined between the approach portion of the die and the forward end of the sealing portion of the mandrel being smaller than the smallest thickness of the nose portion of the billet at its forward end, whereby the frusto-conical nose or tip portion of the billet will be interposed between said conical sealing portion of said mandrel and said approach portion of said die at a position substantially upstream of said extrusion interstice.

10. Apparatus as set forth in claim 9, wherein:

said sizing portion of said mandrel is non-circular in cross-section; and said mandrel additionally includes an intermediate portion interposed between said sealing and sizing portions and having a non-circular configuration in cross-section for facilitating the flow of said billet into said interstice, whereby a tube having a non-circular cross-sectional configuration may be extruded.

11. Apparatus as set forth in claim 10, wherein further:

a portion of the inner peripheral surface of said die, interposed between said approach portion and said bearing portion, has a non-circular configuration in cross-section so as to cooperate with said intermediate portion of said mandrel in forming said tubes having non-circular configurations in cross-section, said portion being blended into said bearing and approach portions at the forward and rearward ends thereof so as to facilitate smooth flow of said billet as the same is being extruded.

12. Apparatus as set forth in claim 10, wherein further:

said intermediate portion has a substantially reduced diameter portion so as not to contact the inner surface of said billet during extrusion thereof and thereby define a space therebetween, whereby free sinking of said billet is facilitated.

13. Apparatus as set forth in claim 12, wherein further:

passage means disposed within said mandrel for permitting communication between said space formed between said intermediate portion of said mandrel and said inner surface of said billet with atmosphere, thereby alleviating any inclusion of fluid within said space.

14. Apparatus as set forth in claim 9, wherein:

said sizing portion includes a plurality of cylindrical cores, whereby a tube having a plurality of bores therethrough may be extruded.

15. Apparatus as set forth in claim 9, wherein:

said sizing portion of said mandrel is eccentrically disposed with respect to said bearing portion of said die, whereby a tube having an eccentric bore may be extruded.

16. Apparatus as set forth in claim 9, further comprising:

position-aligning means for restricting the movement of the rear end portion of said mandrel and for maintaining the axial and circumferential portion of said mandrel throughout the pressure-increasing and extrusion phases, thereby facilitating the extrusion of tubes having walls of non-circular configurations in cross-section.

17. Apparatus as set forth in claim 16, further comprising:

mandrel supporting means for supporting said mandrel within said container;

axially extending groove means provided within the outer peripheral surface of said position aligning means; and through holes provided within said mandrel supporting means and fluidically connected with said groove means, whereby pressure may be transmitted through said position-aligning means and said mandrel supporting means to said billet for attaining said extrusion.

18. Apparatus as set forth in claim 16, further comprising:

spacer means interposed between a large-diameter portion of said mandrel and said position-aligning means, the thickness of said spacer means being dependent upon the elastic elongation of said mandrel when subjected to the extrusion pressures which in turn is dependent upon the deformation resistance of said billet and the extrusion ratio.

whereby proper axial positioning of said mandrel relative to said die is insured.

19. Apparatus as set forth in claim 9, wherein further said mandrel comprises:

a head portion; and a body portion separable from said head portion, said portions being capable of being brazed together by means of a material which is soft and has a relatively low melting point so as to thereby prevent yield of the brazed joint between said head and body portions under pressurized conditions.

* * * * *